US006662845B1

(12) United States Patent
Palmer

(10) Patent No.: US 6,662,845 B1
(45) Date of Patent: Dec. 16, 2003

(54) ROMAN SHADE WITH SEPARATED BACKING SHEET

(75) Inventor: Roger C. Palmer, Greensboro, NC (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/175,575

(22) Filed: Jun. 19, 2002

(51) Int. Cl.[7] ..... E06B 3/48
(52) U.S. Cl. ..... 160/84.01; 160/330
(58) Field of Search ..... 160/84.01, 126, 160/330, 348, 179

(56) References Cited

U.S. PATENT DOCUMENTS

| | | | | |
|---|---|---|---|---|
| 3,856,072 A | * | 12/1974 | Sund | 160/84.01 |
| 4,685,986 A | | 8/1987 | Anderson | |
| 4,694,545 A | | 9/1987 | Dernis | |
| 4,871,006 A | | 10/1989 | Kao et al. | |
| 4,907,635 A | | 3/1990 | Bunger et al. | |
| 5,104,469 A | | 4/1992 | Colson | |
| 5,158,632 A | | 10/1992 | Colson et al. | |
| 5,273,096 A | | 12/1993 | Thomsen et al. | |
| 5,313,998 A | | 5/1994 | Colson et al. | |
| 5,355,928 A | | 10/1994 | Robertson | |
| 5,425,408 A | | 6/1995 | Colson | |
| 5,566,734 A | * | 10/1996 | Levy et al. | 160/84.04 |
| 5,566,735 A | | 10/1996 | Jelic | |
| 5,649,583 A | | 7/1997 | Hsu | |
| 5,690,156 A | | 11/1997 | Ruggles | |
| 5,787,951 A | | 8/1998 | Tonomura et al. | |
| 5,894,876 A | * | 4/1999 | O'Brien | 160/84.01 |
| 6,116,319 A | * | 9/2000 | Simon | 160/84.01 |
| 6,354,353 B1 | * | 3/2002 | Green et al. | 160/84.04 |
| 6,502,619 B1 | * | 1/2003 | Kraeutler | 160/84.01 |

FOREIGN PATENT DOCUMENTS

EP 0 779 407 A 6/1997

OTHER PUBLICATIONS

International Search Report; PCT/US 03/05011, report dated Jun. 13, 2003.*

* cited by examiner

*Primary Examiner*—Blair M. Johnson
(74) *Attorney, Agent, or Firm*—Marshall, Gerstein & Borun LLP

(57) ABSTRACT

A roman shade and method of manufacturing a roman shade are disclosed. The shade may include a first sheet having a plurality of lateral folds therein, a plurality of laterally drooping compartments as well as a second or back sheet which is planar in shape and completely separated from the first sheet. The first sheet may be connected to a cord for raising and lowering the shade through various mechanisms which may include a plurality of rings mounted about both the cords, and a ribbon connected to each of the folds of the first sheet.

18 Claims, 6 Drawing Sheets

ROMAN SHADE WITH SEPARATED BACKING SHEET

FIELD OF THE DISCLOSURE

The disclosure generally relates to window coverings and, more particularly, relates to retractable window shades.

BACKGROUND OF THE DISCLOSURE

Treatments and coverings for windows, doors, and other architectural openings, are well known and myriad in their available styles. For example, venetian blinds, vertical blinds, mini-blinds, drapes, shades, and the like can all be used to block such openings to various degrees and to suit various aesthetic requirements and/or tastes.

One other type of covering is known as a roman shade. With such a device, a sheet is provided with a plurality of lateral pleats or folds to provide the device with a scalloped or downwardly cascading appearance when the covering is fully extended. A cord or ribbon is connected to each of the folds to ensure each is held at a height sufficient to produce the cascading appearance.

Colson, U.S. Pat. No. 5,425,408, discloses one such roman shade. Front and back sheets are provided and connected between top and bottom rails. The front sheet is substantially longer than the back sheet. The back sheet is planar in shape, while the front sheet is provided with a plurality of laterally-spaced folds. Each fold is fixedly attached to the back sheet as by sewing or adhesive. Each fold is so secured at a height sufficient to cause a series of droops or sags in the front sheet.

In another patent to Colson, U.S. Pat. No. 5,144,469, front and back sheets are again provided, but both include lateral pleats. However, the pleats are longitudinally offset. The front sheet pleats are then raised to the level of a corresponding back sheet pleat and secured thereto to create the desired cascading appearance. The respective pleats are secured together either by adhesive or stitching, with or without a separate strip material therebetween.

In still further embodiments, the back sheet is provided in the form of a plurality of pleated segments. U.S. Pat. No. 5,158,632, also issued to Colson, et al., discloses such a structure. Accordingly, not only is the backing sheet not planar, but the front sheet is again fixedly secured to the back sheet using adhesive.

A need therefore exists for a roman shade having first and second sheets forming a plurality of lateral cells, but having a planar back sheet to, among other things, ensure coverage of the architectural opening, and having a back sheet separate from the front sheet to, among other things, provide a clean aesthetic appearance.

SUMMARY OF THE DISCLOSURE

In accordance with one aspect of the disclosure, a shade is provided which may comprise, a head rail, a first sheet, a second sheet, a plurality of rings, a ribbon, and a cord. The first sheet may be connected to the head rail and include a plurality of lateral folds. The second sheet may also be connected to the head rail and include a plurality of apertures. The second sheet may be substantially planar when the shade is in a fully extended position. One ring or a plurality of rings may extend through each aperture in the second sheet. The ribbon is connected to the head rail and extends through each ring. The ribbon is further connected to each fold of the first sheet and is provided between the first sheet and the second sheet. The cord may be connected to the head rail and extend through each of the rings with the second sheet being placed between the ribbon and the cord.

In accordance with another aspect of the disclosure, a shade may be provided which may comprise a head rail, a bottom rail, a first sheet, a second sheet, a cord, and means for connecting the first sheet to the second sheet. The first and second sheets may extend between the head rail and the bottom rail. The cord may extend between the head rail and the bottom rail, the second sheet being placed between the first sheet and the cord.

In accordance with another aspect of the disclosure, a method of manufacturing a shade is provided which may include folding a first sheet so as to have a plurality of lateral folds, knotting a plurality of rings onto a ribbon, connecting a ribbon to the first sheet proximate each fold with at least one ring being provided on the ribbon between adjacent folds, extending each of the rings through apertures provided in a second sheet, stringing a cord through each of the rings with the second sheet being between the first sheet and the cord after such stringing, connecting first ends of the first sheet, ribbon, and second sheet to a head rail, connecting second ends of the first sheet, ribbon, and second sheet to a bottom rail, connecting a first end of the cord to the bottom rail, and stringing a second end of the cord through an opening in the head rail and through a brake mounted in the head rail.

These and other aspects and features of the disclosure will become more apparent upon reading the following detailed description when taken in conjunction with the accompanying drawings.

Figure 1:
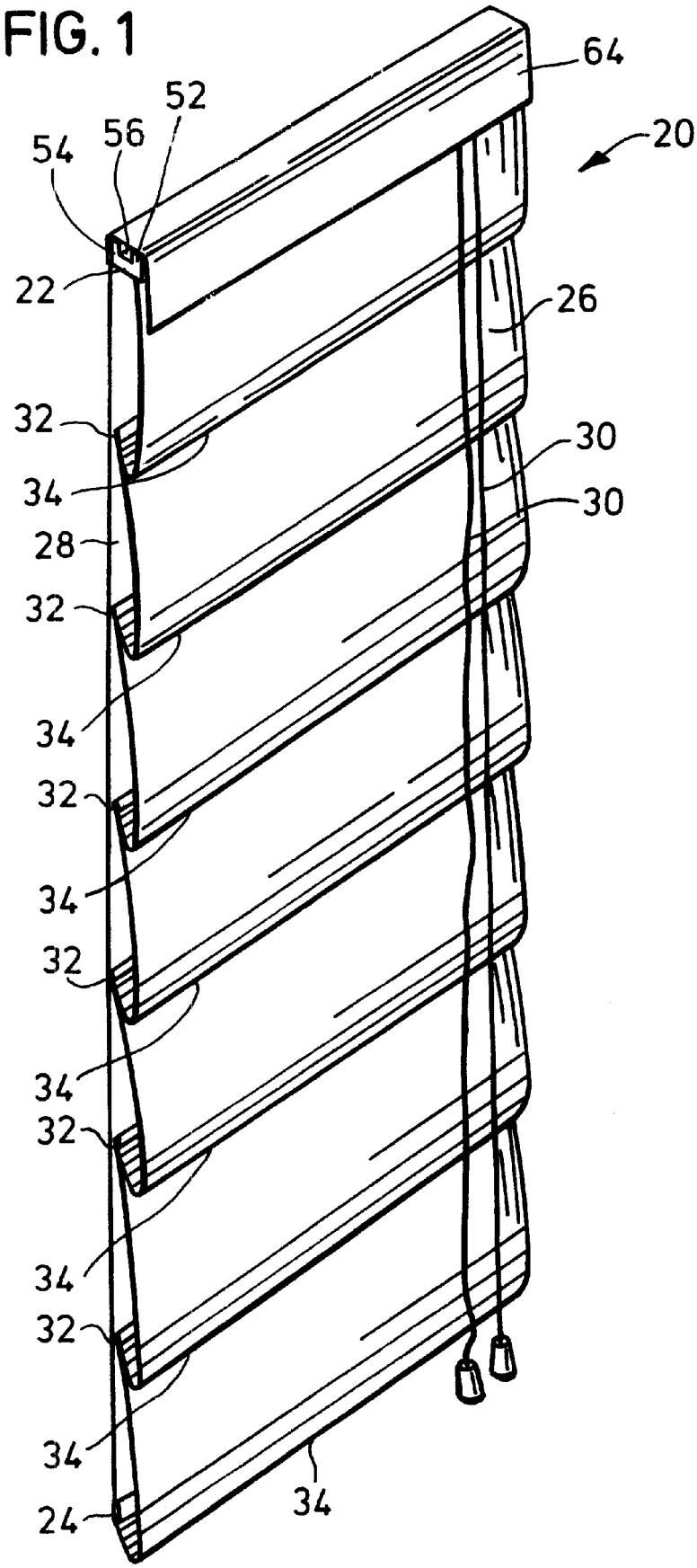
FIG. 1 is a front perspective view of a shade constructed in accordance with the teachings of the disclosure and depicted in an extended position.

Although the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION

Referring now to the drawings, and with specific reference to FIG. 1, a roman shade constructed in accordance with the teachings of the disclosure is generally referred to by reference numeral 20. Although the shade 20 will be described below in reference to a window shade or covering, it is to be understood that such a structure can be used in conjunction with any type of opening, including architectural openings such as doors and the like.

Figure 2:
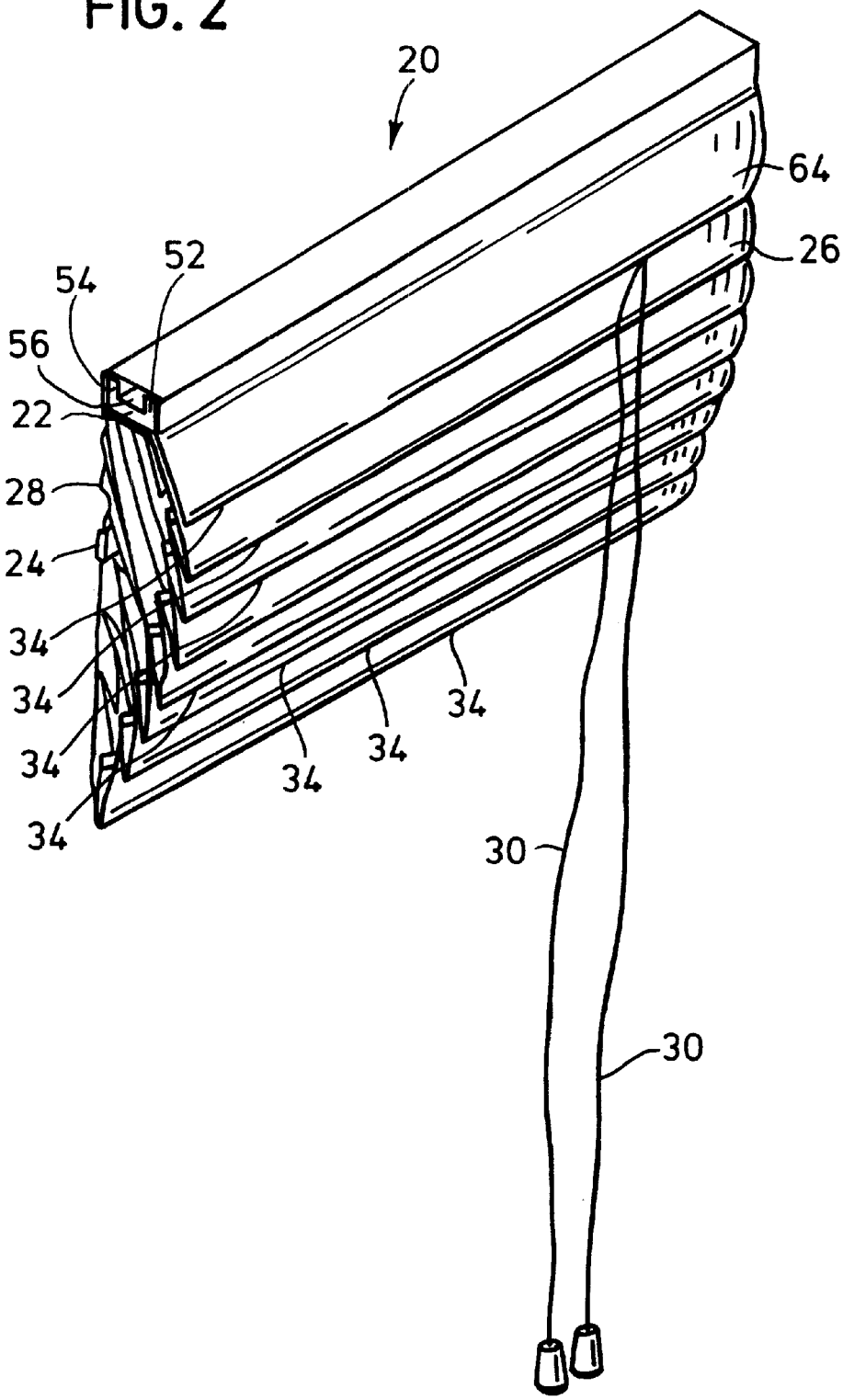
FIG. 2 is a perspective view of the shade of FIG. 1, but depicted in a retracted position.

The shade 20 may include a head rail 22 and a bottom rail 24 with a first front sheet 26 and a second or back sheet 28, extending therebetween A cord or cords 30 may be used to retract the shade 20 from the extended position shown in FIG. 1 to the retracted position shown in FIG. 2. It is to be understood that the shade 20 can of course be positioned in a variety of other positions to vary the degree of extension, by appropriate manipulation of the cord 30.

As shown best in FIG. 1, when the shade 20 is provided in the extended position, the front sheet 26 is provided with a scalloped or cascading appearance in that a plurality of lateral folds 32 are provided and positioned so as to create a plurality of cells 33 separated by a plurality of sags or droops 34 in the material forming the first sheet 26. The first sheet 26, as well as the back sheet 28, may be provided in the form of cloth such as cotton or linen, or could be provided in a variety of other materials including, but not limited to, plastic, paper, and other fabrics.

Figure 3:
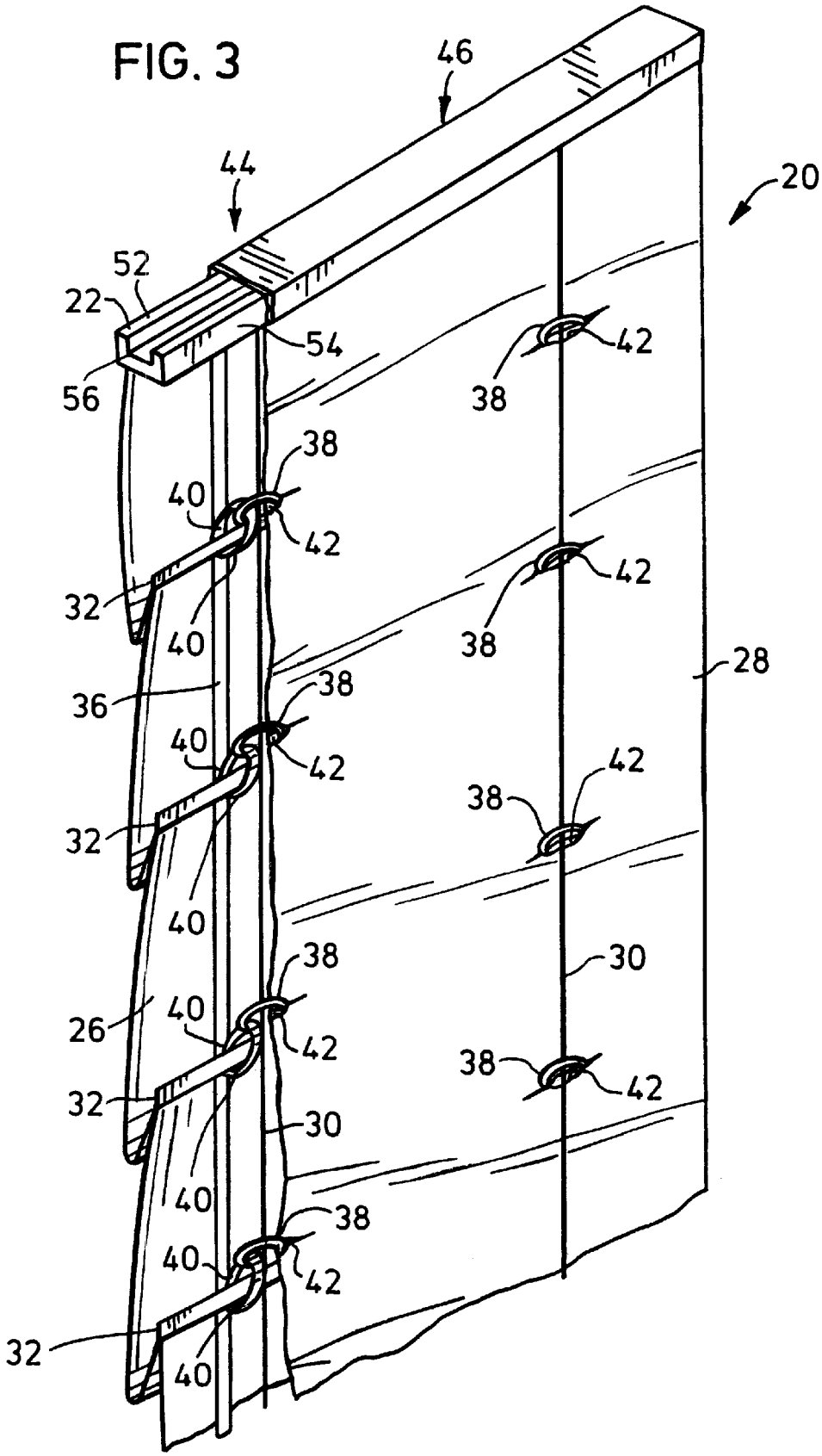
FIG. 3 is a rear perspective, cutaway view of the shade of FIG. 1.
Figure 5:
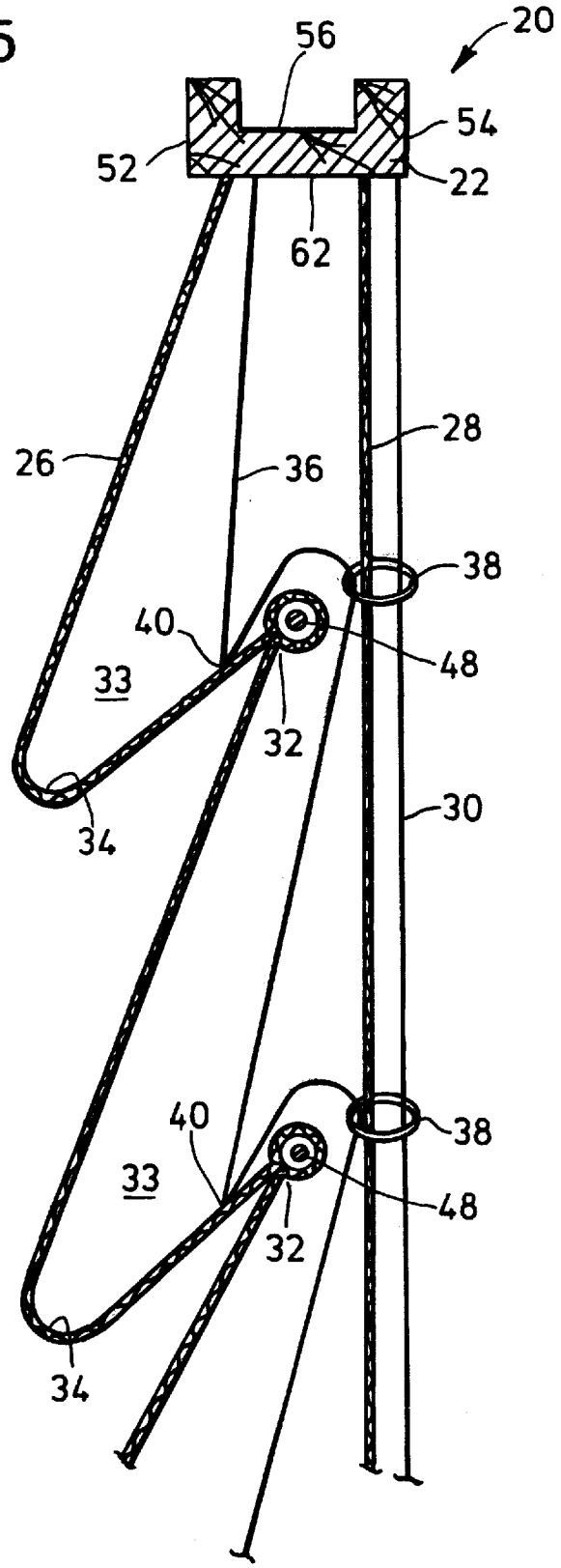
FIG. 5 is an enlarged sectional view of FIG. 1 taken along line 5—5 of FIG. 1.

Referring now to FIGS. 3 and 5, it can be seen that while the first sheet 26 is substantially scalloped or cascading in cross section, the second sheet 28 is substantially planar in shape. In so doing, the first sheet 26 is able to provide the user with the desired aesthetic appearance, while the second sheet 28 is able to closely and accurately follow the shape of the opening (not shown) desired to be covered.

From FIGS. 3 and 5, it will also be noted that the first sheet 26 and back sheet 28 are not directly joined together, but rather the back sheet 28 is fully separate from the front sheet 26. Such a feature has the advantage, among other things, of providing a clean, draping appearance for the shade 20.

In order to raise and lower the shade 20 in an orderly fashion, the cord 30, however, is indirectly connected to the first sheet 26. As shown in FIG. 3, this may be provided in the form of a connection or connecting means including a ribbon 36 as well as a plurality of rings 38. As will be noted, the ribbon 36, which may be provided in the form of a cloth strip or the like, extends from the head rail 22, and connects to the first sheet 26 at a plurality of locations 40, each being proximate to one of the lateral folds 32. The ribbon 36 may be so connected by adhesive, stitches, or the like. Between each location 40, it will be noted that one ring 38 is provided. Each of the rings 38 is mounted about the ribbon 36, as well as the cord 30. The second sheet 28 is provided with a plurality of apertures 42 enabling the rings 38 to pass therethrough. It is to be understood that while the rings 38 are provided in the form of annular members, any other shape including, but not limited to, ovals, squares, rectangles, or any other form of polygon would suffice.

In one embodiment, as shown best in FIG. 3, the second sheet 28 may be provided with first and second columns 44, 46 of apertures 42. In addition, first and second ribbons 36 are provided and aligned with the first and second columns 44, 46. Accordingly, first and second sets of rings 38 are provided for mounting about each of the ribbons 36, and passage through the apertures 42 of the first and second columns 44 and 46.

In order to maintain the lateral rigidity of each of the lateral folds 32, a reinforcing bar 48 may be mounted into each of the folds 32. More specifically, as shown in FIG. 5, a metal rod 48 may be positioned within each of the folds 32, with adjacent sides of the first sheet 26 then being stitched or adhered together as indicated by a joint 50 to secure the reinforcing bar 48 therein. Such a bar 48 has the benefit of ensuring that each of the folds 32 maintains a substantially horizontal shape and therefore maintains the desired aesthetic appearance for the shade 20.

Figure 4:
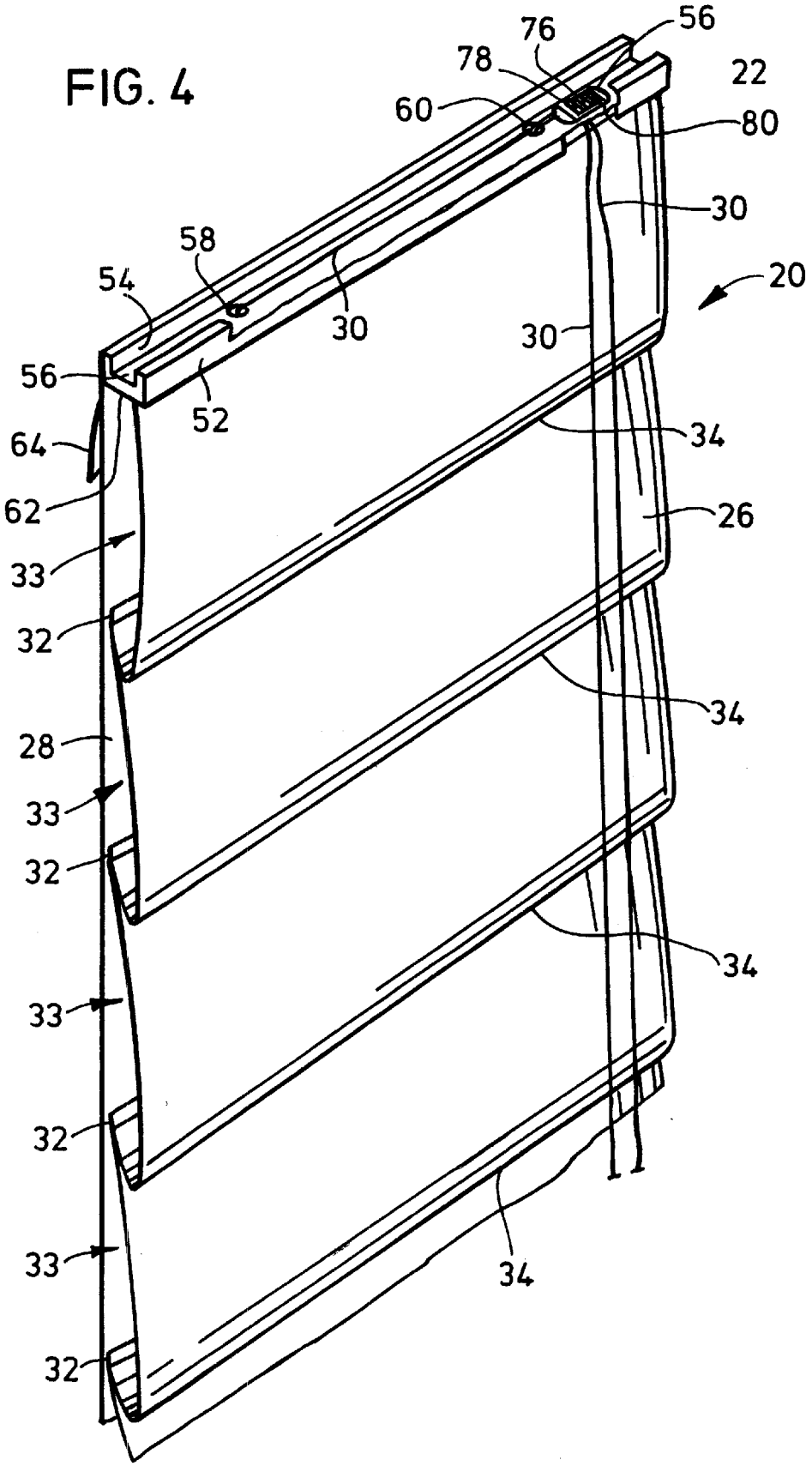
FIG. 4 is an enlarged fragmentary front perspective view, with the head nail illustrated in detail.

Referring now to FIG. 4, the head rail 22 is shown in further detail. The head rail 22, which may be provided in the form of a plastic, wood, or the like, includes a front surface 52, as well as a back surface 54, an interior chamber 56, cord apertures 58, 60, and a bottom surface 62. While the ribbon 36 and front sheet 26 is mounted to the bottom surface 62, the back sheet 28 may be mounted to the back surface 54. Moreover, the back sheet 28 may extend above the head rail 22 and forms an additional scallop 64. The additional scallop 64 is able to wrap around or droop over the front surface 52 of the head rail 22 (see FIG. 1) so as to hide the head rail 22 and thus preserve the aesthetic appearance of the shade 20. In addition, the scallop 64 may include a strip (not shown) proximate the back surface 54 of the head rail 22 whereon an attachment mechanism such as a strip of tongue and loop fasteners may be provided. In turn, the second sheet 28 may include a strip (not shown) of similar fasteners enabling the second sheet 28 to be secured to the front sheet 26 in a removable fashion to facilitate cleaning and the like. It is to be understood that other forms of fasteners, including but not limited to buttons, strings, ties, and the like, are certainly possible.

The first and second cord apertures 58 and 60 are provided to enable the cords 30 to pass therethrough for connection to a brake 76 as shown in FIG. 4. The brake 76 is mounted within the chamber 56 and may be provided in the form of a conventional brake having a fixed shaft or mandrel 78 as well as a movable gear wheel 80. As is conventional, the chamber 56 may include an actuate interior surface (not shown) having a plurality of gear teeth 82 of similar size and pitch to those of the gear wheel 80. The interior surface 81 of the chamber 56 is actuate to facilitate braking of the cords between the gear wheel 80 and the mandrel 78. More specifically, when the first and second cords 30 are trained between the mandrel 78 and the gear wheel 80 and the cord is pulled in a first direction, the gear wheel 80 drops, via gravity, out of contact with the interior surface and thereby allows the gear wheel 80 to rotate freely and for the cords to move freely. Such movement enables the shade 20 to be easily extended. If it is desired to lock the shade 20 into a given position, the cords 30 can simply be pulled in the opposite direction. In so doing, sufficient force is exerted on the movable gear wheel 80 to force its gear teeth into engagement with the gear teeth provided on the interior surface of the chamber 56. Accordingly, when a user partially releases the cords 30, and the weight of the shade 20 tends to pull downwardly, while the cords are continued to be pulled in the first direction, the gear wheel 80 rotates while in contact with the interior surface until the user completely lets go, and the cords are trapped between the mandrel 78 and the now engaged teeth of the wheel 80 and the interior surface.

Figure 6:
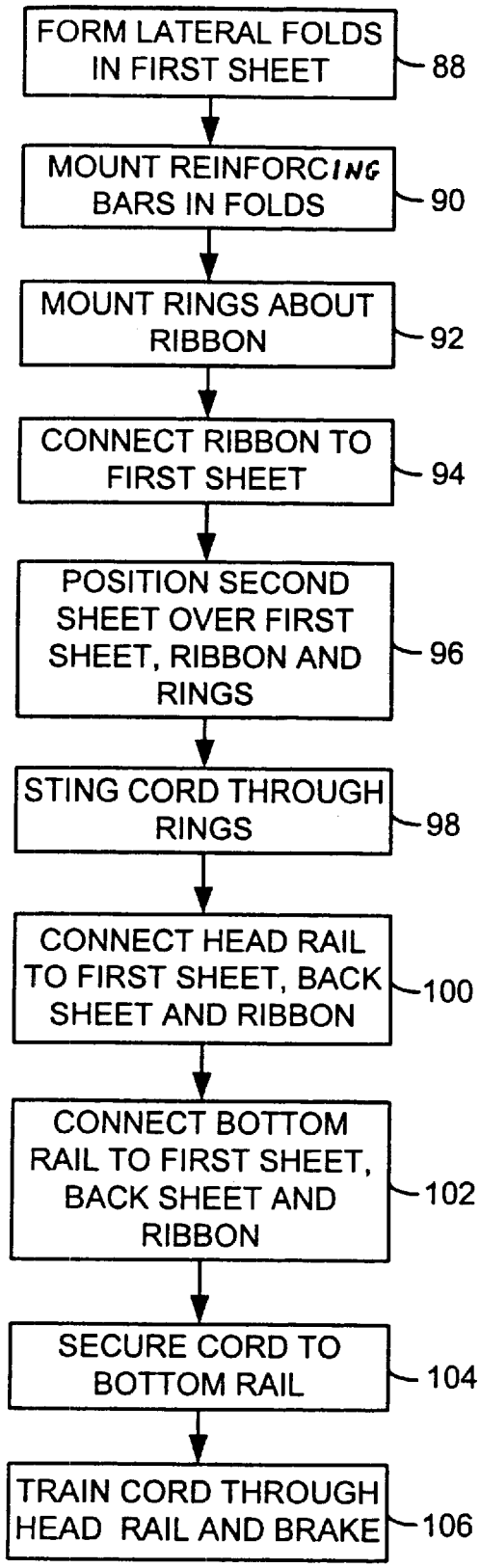
FIG. 6 is a flowchart depicting a sample sequence of steps which may be taken according to the teachings of the disclosure.

In order to manufacture such a shade 20, a variety of methods can be employed. However, as indicated in the flow chart of FIG. 6, one possible method may include a first step 88 of forming a plurality of lateral folds 32 into the first sheet 26. A second step 90 may then be to mount the reinforcing bars 48 within each of the folds 32. Third and fourth steps 92 and 94 may be to mount a plurality of rings 38 about a ribbon 36 and then connect the ribbon 36 to the first sheet 26. The ribbon 36 may be connected to the first sheet 26 at the plurality of locations 40 such that at least one ring 38 is provided between adjacent pairs of locations. Once such an assembly is formed, the second sheet 28 can be positioned over the first sheet 26 and ribbon 36 such that the rings 38 pass through the plurality of apertures 42. This is indicated in the step 96 in FIG. 6. The cord 30 can then be strung through each of the rings 38 as indicated by a step 98. The head and bottom rails 22 and 24 can then be connected to each of the first sheet 26, back sheet 28, and ribbon 36, as indicated in steps 100, 102, respectively. In another step 104, a first end 104 of the cord 30 may be secured to the bottom rail 24, and in a step 106, a second end 108 of the cord 30 may be strung through cord aperture 58 and trained between the mandrel 78 and the gear wheel 80 to complete the shade 20.

From the foregoing, it will be appreciated that the disclosure provides a shade apparatus and method of manufacturing same.

What is claimed is:

1. A shade, comprising:

a head rail;

a first sheet connected to the head rail, the first sheet having a plurality of lateral folds;

a second sheet connected to the head rail and including a plurality of apertures therein, the second sheet being substantially planar when the shade is in a fully extended position;

a plurality of rings, one ring extending through each aperture in the second sheet;

a ribbon connected to the head rail and extending through each ring, the ribbon being connected to each fold of the first sheet and being provided between the first sheet and the second sheet; and a cord connected to the head rail and extending through each of the rings, the second sheet being between the ribbon and the cord.

2. The shade of claim 1, wherein the second sheet includes first and second columns of apertures, one of the rings being provided through each aperture, the shade including first and second cords, the first cord being associated with the first column, the second cord being associated with the second column.

3. The shade of claim 1, wherein the first sheet, second sheet and ribbon are fixedly attached to the head rail, and wherein the cord is movably mounted through multiple holes in the head rail.

4. The shade of claim 1, further including a reinforcing bar mounted within each fold.

5. The shade of claim 1, further including a bottom rail, the first sheet, second sheet, ribbon, and cord being attached to the bottom rail.

6. The shade of claim 1, wherein the first sheet is longer than the second sheet.

7. A shade, comprising:

a head rail;

a bottom rail;

a space between said first and second sheet;

a first sheet extending between the head rail and the bottom rail;

a second sheet extending between the head rail and the bottom rail;

a cord extending between the head rail and the bottom rail, the second sheet being between the first sheet and the cord; and means for connecting the first sheet to the cord without directly connecting the first sheet to the second sheet.

8. The shade of claim 7, wherein the second sheet includes at least one aperture, and the means for connecting includes a ribbon connected to the first sheet and extending through a ring mounted around the cord and extending through the second sheet aperture.

9. The shade of claim 8, wherein the second sheet includes a plurality of apertures, and the connecting means includes a plurality of rings, each ring extending through one of the apertures and being mounted around the cord, the ribbon being connected to the first sheet at multiple locations, the number of locations being equal to the number of rings.

10. The shade of claim 9, wherein the first sheet includes a plurality of folds, the ribbon being connected to the first sheet proximate each of the folds.

11. The shade of claim 10, wherein the first sheet includes a reinforcing bar mounted within each of the folds.

12. The shade of claim 7, further including a shaft and a movable gear mounted within the head rail, the cord extending from the bottom rail through an aperture in the head rail, and between the shaft and the movable gear.

13. The shade of claim 7, further including first and a second cords.

14. A method of manufacturing a shade, comprising:

folding a first sheet so as to have a plurality of lateral folds;

mounting a plurality of rings onto a ribbon;

connecting the ribbon to the first sheet proximate each fold, at least one ring being provided on the ribbon between adjacent folds;

extending each of the rings through apertures provided in a second sheet;

stringing a cord through each of the rings, the second sheet being between the first sheet and the cord after stringing;

connecting first ends of the first sheet, ribbon and second sheet to a head rail;

connecting second ends of the first sheet, ribbon, and second sheet to a bottom rail;

connecting a first end of the cord to the bottom rail; and stringing a second end of the cord through an opening in the rail and through a brake mounted in the head rail.

15. The method of manufacturing a shade of claim 14, further including mounting a reinforcing bar within each fold of the first sheet.

16. The method of claim 15, wherein the reinforcing bar is mounted by stitching the first sheet together to form the folds, with the reinforcing bar being trapped between the stitches and end fold.

17. The method of claim 15, further including mounting rings to a second ribbons, connecting the second ribbons to the first sheet, extending the rings through apertures in the second sheet, and stringing a second cords through the rings.

18. The method of claim 14, wherein the first sheet is longer than the second sheet.

* * * * *

UNITED STATES PATENT AND TRADEMARK OFFICE

CERTIFICATE OF CORRECTION

PATENT NO. : 6,662,845 B1
DATED : December 16, 2003
INVENTOR(S) : Roger C. Palmer It is certified that error appears in the above-identified patent and that said Letters Patent is hereby corrected as shown below:

Column 5,
Lines 53-54, please delete "a space between said first and second sheet; a first sheet extending between the head rail and the bottom rail; a second sheet extending between the head rail and the bottom rail;" and insert -- a first sheet extending between the head rail and the bottom rail; a second sheet extending between the head rail and the bottom rail; a space between said first and second sheets --.

Column 6,
Lines 24-25, please delete " first and a second cords." and insert -- a second cord. --.
Line 55, please delete "ribbons, connecting the second ribbons" and insert -- ribbon, connecting the second ribbon --.
Line 57, please delete "cords" and insert -- cord --.

Signed and Sealed this

Sixth Day of July, 2004

JON W. DUDAS
*Acting Director of the United States Patent and Trademark Office*